United States Patent [19]

Lawton et al.

[11] 4,228,601

[45] Oct. 21, 1980

[54] SNOW-SHOE

[75] Inventors: Peter Lawton, 104 Hägerstensvägen, Hägersten, Sweden, S-126 49; Per Börjesson, Stockholm, Sweden

[73] Assignee: Peter Lawton, Hägersten, Sweden

[21] Appl. No.: 924,758

[22] Filed: Jul. 14, 1978

[51] Int. Cl.[3] ..... A43B 5/04

[52] U.S. Cl. ..... 36/124; 36/125

[58] Field of Search ..... 36/122, 123, 124, 125

[56] References Cited

U.S. PATENT DOCUMENTS

| | | | |
|---|---|---|---|
| 3,269,037 | 8/1966 | Massicotte | 36/124 |
| 3,484,958 | 12/1969 | Novak et al. | 36/123 |
| 3,555,707 | 1/1971 | Sharratt et al. | 36/123 |
| 3,760,513 | 9/1973 | Corneliusen | 36/124 |

*Primary Examiner*—Patrick D. Lawson

*Attorney, Agent, or Firm*—Kenyon & Kenyon

[57] ABSTRACT

Snow-shoe with a hingedly divided frame in order to facilitate walking.

4 Claims, 2 Drawing Figures

SNOW-SHOE

This invention relates to a snow-shoe consisting of a frame, a support surface arranged within the frame and a clamping means for a shoe.

In order to make possible walking in snow it is previously known to use snow-shoes. These have a relatively big support surface to distribute the carrier's weight and to prevent in this way sinking in snow.

Known snow-shoes are often clumsy and require a special gait, which is quite different from a natural one. Each snow-shoe must have a sufficiently big support surface to distribute the carrier's whole weight, as the latter only rests on one snow-shoe in walking. Often known snow-shoes prevent a natural motion of the foot in walking as the snow-shoe consists of a rigid frame with an intermediate support surface.

This invention provides a snow-shoe allowing an almost natural gait at the same time as it will be possible to carry out work with the snow-shoe clamped to the shoe, e.g. in a crouched position. By the present invention a snow-shoe is obtained, which is simple, light, simple to manufacture and permits a natural gait. According to the present invention this is achieved by the snow-shoe obtaining the characteristic features defined in the claims.

Figure 1:
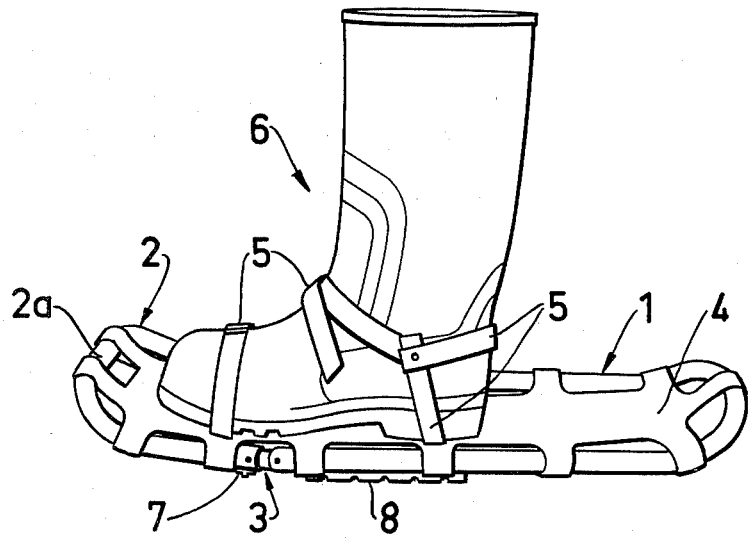
Figure 2:
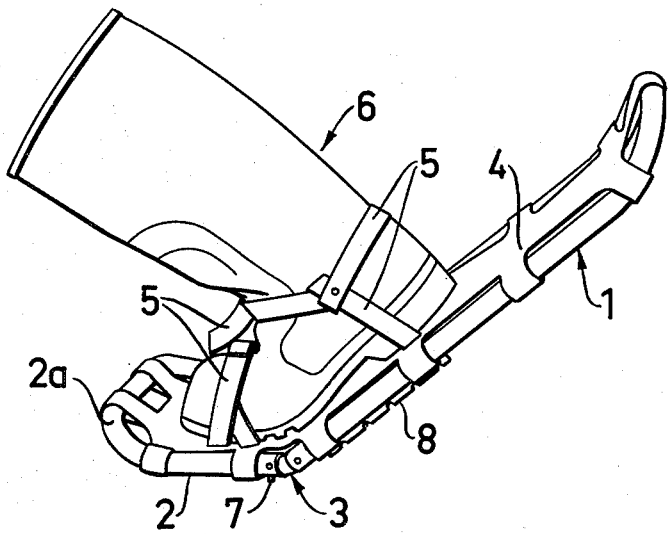

The invention will be described in connection with an illustrative example shown, wherein FIG. 1 is a perspective view of a snow-shoe according to the invention with a clamped shoe in a horizontal (not articulated) position and wherein FIG. 2 is a perspective view of the articulation of the snow-shoe.

The snow-shoe consists of a rear frame portion 1 and a front frame portion 2, whose front part 2A is upwardly directed to some extent. Articulating elements 3 are disposed between the front and the rear frame portion and are rigidly connected with these. As illustrated, the elements 3 are formed by rod-shaped elastic bodies inserted and fixed in recesses formed in the mutually adjacent ends of the frame portions 1 and 2. A support surface 4 is arranged at the frame portions and consists preferably of a flexible material to which snow adheres or sticks with difficulty. A clamping means 5 of a shoe 6 is arranged on the upper side of the snow-shoe and can consist of known lace means and clamping means of footwear.

Anti-skid means 7, 8 are preferably arranged at the frame portion.

As the articulation of the snow-shoe is arranged in connection with or on the same level as the articulation of the foot immediately in front of the arch of the foot, a substantially natural gait is possible. The articulation does not influence injuriously the supporting capacity of the snow-shoe, either, as the articulation, the position shown in FIG. 2, is only utilized when a relatively small portion of the total body weight rests on the angularly bent snow-shoe in walking. By providing the snow-shoe with a relatively large longitudinal extension a natural gait is also made possible, and therefore reduced stresses will arise on thighs and sinews than is the case with existing snow-shoes, which require a gait with the legs wide apart. The articulation of the snow-shoe also simplifies works when standing on the knees, e.g. in timber-cutting, and does not prevent by its design, either, that work is carried out with e.g. a power saw. The risk has then been eliminated that the snow-shoe is damaged as its rear frame portion has been given a longer extension in comparison with the front one, which does not bring any impaired supporting capacity.

The rod-shaped elastic bodies 3 inherently resiliently hold the two frame portions 1 and 2 in alignment as shown by FIG. 1 but can bend for walking action as shown by FIG. 2.

The invention is not restricted to the illustrative example shown, but modifications can be made within the scope of the following patent claims.

What we claim is:

1. A snow-shoe comprising a snow-shoe frame having a support surface adopted to support said frame on a snow surface and fastening means for fastening the snow-shoe to a shoe at a position between the opposite ends of the frame, said frame comprising front and rear portions having mutually adjacent ends positioned below said means and which are interconnected by elastic means for holding said ends against separation and resiliently biased so as to normally hold said portions in alignment with each other and elastically permitting said portions to angularly deflect relative to each other so as to substantially conform to bending of a shoe fixed to the snow shoe by said fastening means.

2. The snow-shoe of claim 1 in which said elastic means comprise rod-shaped elastic bodies inserted and fixed in recesses in said mutually adjacent ends of said front and rear portions of said frame.

3. The snow-shoe of claim 1 in which said fastening means is positioned to fasten the shoe to said frame so that said mutually adjacent ends of said frame and said elastic means are positioned substantially immediately in front of the arch of a shoe fastened to the snow-shoe by the fastening means.

4. The snow-shoe of claim 3 in which the frame's said rear portion is longer than the frame's said front portion and the latter has a front part that is upwardly directed.

* * * * *